US005185906A

United States Patent [19]

Brooks

[11] Patent Number: 5,185,906

[45] Date of Patent: Feb. 16, 1993

[54] BELT CLIP SPRING WITH E-RING FASTENER

[75] Inventor: Dwight D. Brooks, Boynton Beach, Fla.

[73] Assignee: Motorola, Inc., Schaumburg, Ill.

[21] Appl. No.: 919,796

[22] Filed: Jul. 27, 1992

[51] Int. Cl.[5] ..... A44B 21/00

[52] U.S. Cl. ..... 24/35; 24/511; 224/252; 224/269

[58] Field of Search ..... 24/507, 508, 511, 3 R, 24/3 J, 3 L, 67.7, 499, 500; 411/516; 455/351; 224/252, 269, 271, 272

[56] References Cited

U.S. PATENT DOCUMENTS 4,741,074 5/1988 Budano, II et al. ..... 224/269 X 4,780,934 11/1988 Vickers et al. ..... 24/3 J

*Primary Examiner*—James R. Brittain

*Attorney, Agent, or Firm*—Daniel R. Collopy; William E. Koch; Thomas G. Berry

[57] ABSTRACT

A belt clip assembly clamps a device (30) onto thin material. The device has a backcover (31) which includes a first set of ears (32) with a first set of pin holes. The belt clip assembly comprises a belt clip (44), a pin (130), and a spring (100). The belt clip (44) has a second set of ears (24,26) with a second set of pin holes (20,22); the pin (130) passes through the first set of pin holes and the second set of pin holes (20,22) for establishing an axis of rotation (56); and the spring (100) is formed to apply force to maintain the belt clip (44) in a closed position against the back cover (31). The spring (100) has a retaining ring (120) formed integrally therewith. The retaining ring (120) couples to the pin (130) for retaining the pin (130) within the first and second set of pin holes (20,22).

10 Claims, 2 Drawing Sheets

-PRIOR ART-

-PRIOR ART-

FIG.5
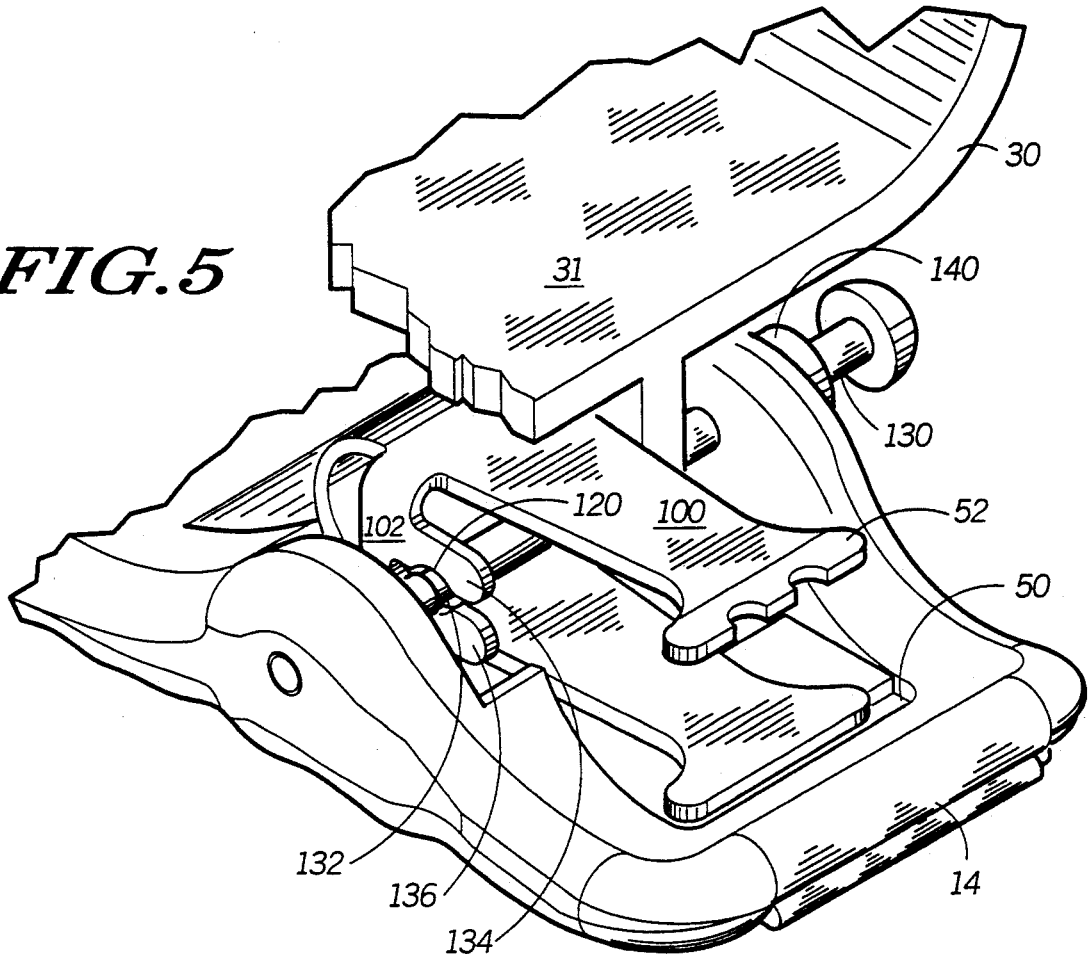
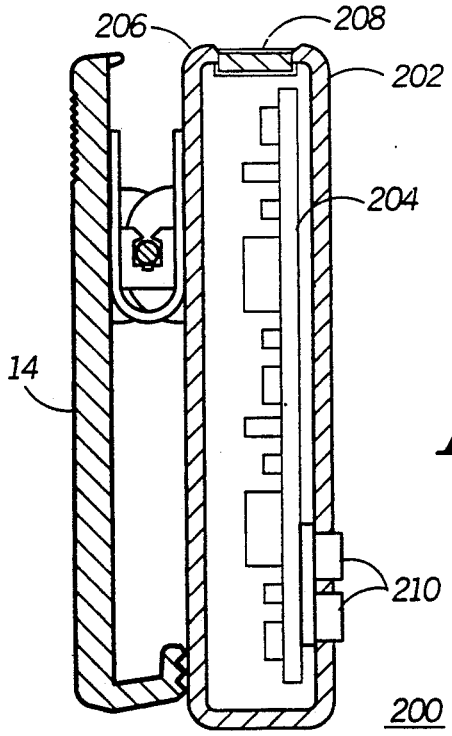
FIG.6

BELT CLIP SPRING WITH E-RING FASTENER

FIELD OF THE INVENTION

This invention relates in general to pin fasteners, and in particular to E-ring pin fasteners for fastening a spring holding pin.

BACKGROUND OF THE INVENTION

Many portable electronic devices, such as radios and selective call radio receivers, can be carried by a user. Some portable electronic devices can be clipped to thin materials such as articles of clothing so that the visible and audible user interface elements can be easily heard and viewed. Additionally, it is preferable that a portable electronic device can be clipped and unclipped from the material easily while, when clipped to the material, the device is securely clamped thereto.

To meet the needs of users, many electronic devices have belt clips attached thereto. Though there are many different types of belt clips, most comprise a pin for allowing rotational motion thereabout and a spring for applying the force necessary to securely clamp the device to a belt or pocket or other article of clothing while allowing a user to unclamp the device by compressing the spring to rotate the belt clip around the pin.

A conventional pin is constructed with a head so that the pin may be inserted through holes in the clip and the device. Prior art belt clip assemblies have used an E-ring to clamp the pin at the end opposite the head so that it does not slide back out the holes. Yet, in manufacture, placement of the E-ring requires additional labor and leads to additional opportunity for latent defects. For example, if the E-ring is not placed on the pin perpendicular to the axis of the pin or within an E-ring groove formed in the pin, the E-ring could work itself off the pin. The pin would fall out of the belt clip assembly and the spring would force the belt clip to pop off.

Thus, what is needed is an E-ring for clamping the pin without requiring additional manufacturing labor and which can secure the pin without being capable of working itself free.

SUMMARY OF THE INVENTION

In accordance with the features and advantages of the present invention, there is provided a belt clip assembly for clamping a device onto thin material. The device has a backcover including a first set of ears with a first set of pin holes therein. The belt clip assembly comprises a belt clip, a pin and a spring. The belt clip has a second set of ears with a second set of pin holes therein; the pin passes through the first set of pin holes and the second set of pin holes for establishing an axis of rotation; and the spring is formed to apply force to maintain the belt clip in a closed position against the back cover. The spring has a retaining ring formed integrally therewith, the retaining ring coupling to the pin for retaining the pin within the first and second set of pin holes.

BRIEF DESCRIPTION OF THE DRAWING

FIG. 5 is a belt clip assembly in accordance with the preferred embodiment of the present invention.

FIG. 6 is a selective call receiver including a belt clip assembly in accordance with the preferred embodiment of the present invention.

DETAILED DESCRIPTION OF THE INVENTION

Figure 1:
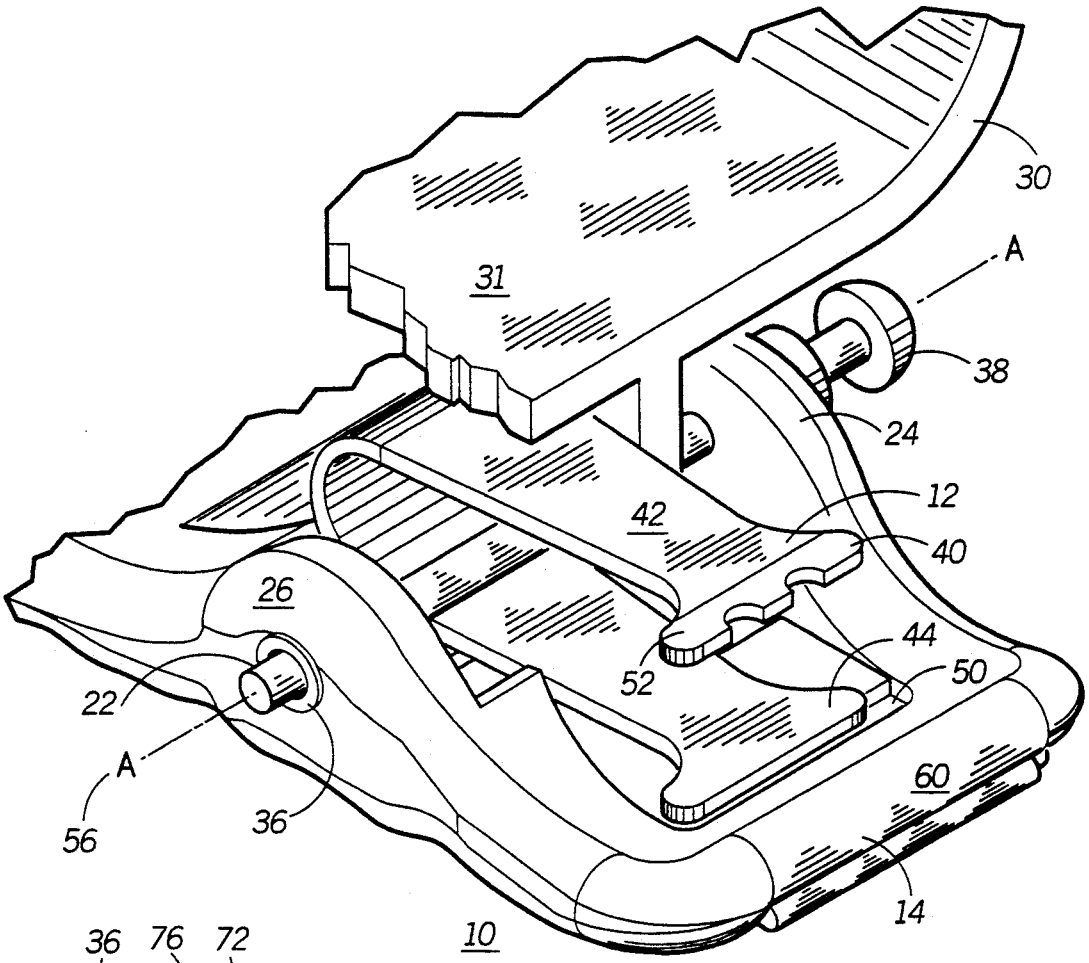
FIG. 1 is an illustration of a conventional belt clip assembly including an E-ring.

Referring to FIG. 1, a conventional belt clip assembly 10 comprises a spring 12, a belt clip 14, and a pin 16. The pin 16 fits through a set of pin holes 20, 22, in ears 24, 26 of the belt clip 14. The pin 16 also fits through pin holes (not shown) in a set of ears protruding from a back cover 31 of a device 30 to be mounted by the belt clip assembly 10. A first set 32 is shown between the ear 24 of the belt clip 14 and the spring 12. A second ear with a pin hole would be located between the spring 12 and the second ear 26 of the belt clip 14. The pin is retained within the pin holes of the ears 24, 32, 26 by an E-ring 36 which slides over the end of the pin 16 and fits into a groove formed therein for receiving the E-ring 36. The head 38 of the pin 16 works in conjunction with the E-ring 36 to prevent lateral movement of the pin 16.

The spring 12 is U-shaped spring which when compressed exerts force at a first end 40 of the top portion 42 of the spring 12 and at a first end 44 of a bottom portion 46 of the spring 12. The top portion 42 and the bottom portion 46 are joined in a U-shape at second ends opposite to the first ends 40, 44. When placed within the belt clip assembly 10, the first end 40 of the spring 12 exerts pressure against the back cover 31 of the device 30 to be retained on an article of clothing, while the first end 44 of the bottom portion 46 of the spring 12 exert force against the belt clip 14. A retaining groove 50 is formed within the belt clip 14 for receiving a protrusion at the first end 44 of the bottom portion 46 of the spring 12 to prevent slippage of the spring 12 Likewise, within the back cover 31 a retaining groove (not shown) is formed to receive the protrusion 52 formed at the first end 40 of the top portion 42 of the spring 12.

The pin 16 passes through the pin holes 20, 22 of the belt clip 14 and the pin holes of the back cover 30 to maintain the spring 12 in a compressed orientation while allowing rotation of the belt clip 14 in relation to the device about an axis A—A 56. Thus, a user of the device could place pressure against the belt clip 14 to cause rotation about the axis 56 such that the spring 12 compresses further and the portion of the belt clip opposite to the portion 60 opens allowing the belt clip 14 to pass over one side of a material and allowing the housing 30 of the device to pass over the opposite end of the material. For example, the user can clip the device to his belt by applying appropriate pressure to the upper portion 60 of the belt clip 14 and the housing 30 of the device to open the bottom portion of the belt clip 14 in relation to the housing 30 in order to pass the clip behind the belt such that when pressure is removed from the belt clip 14 the portion of the belt clip 14 opposite the spring contacted portion 60 is returned to its normal closed position by the force exerted by the spring 12 against the housing 30 and the belt clip 14.

Figure 2:
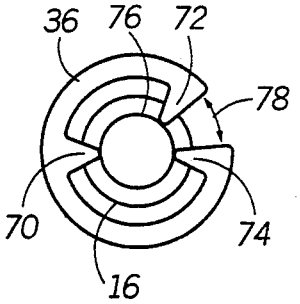
FIG. 2 is an orthogonal view of a conventional E-ring.

Referring to FIG. 2, a conventional E-ring 36 is shown in position around the pin 16. The prongs 70, 72, 74 contact the pin 16 yet are resilient enough so that when slid across the pin 16, the prongs 70, 72, 74 separate and return to their normal position when reaching the grooved portion 76 of the ring 16 formed to receive the E-ring. The resiliency of the E-ring is further enhanced by the spacing 78 between prong 72 and prong 74.

Figure 3:
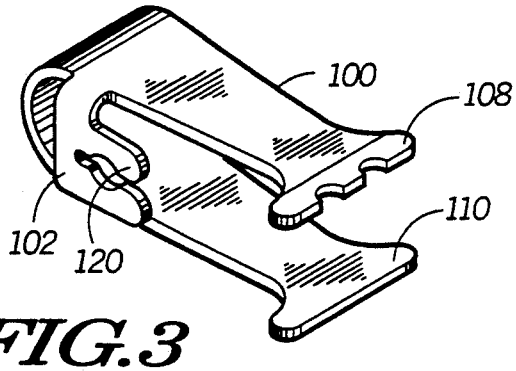
FIG. 3 is an illustration of a spring including a pin retainer in accordance with the preferred embodiment of the present invention.

Referring next to FIG. 3, a spring 100 constructed in accordance with the preferred embodiment of the present invention has integrally formed therewith a retaining portion 102. The top portion 104 is coupled to the bottom portion 106 to provide the spring action and to exert force at a first side 108 of the top portion 104 and at a first side 110 of the bottom portion 106. The retaining portion 102 is formed towards the second side of the top portion 104 and the bottom portion 106 to allow for the spring forces to be exerted at the first sides 108, 110 of the top and bottom portions 104, 106. The retaining portion 102 has an E-ring-type coupling ring 120 formed to wrap around a pin to prevent lateral motion of the pin.

Figure 4:
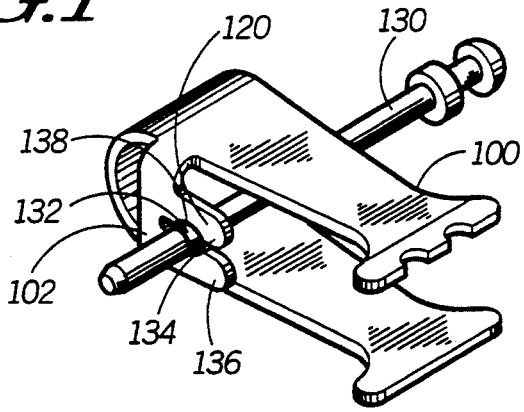
FIG. 4 is an illustration of the spring and pin arrangement in accordance with the preferred embodiment of the present invention.

Referring next to FIG. 4, the relationship between the spring 100 and a pin 130 is shown. The pin 130 has a groove 132 formed therein to receive the retaining portion 102 of the spring 100.

Manufacture of a belt clip assembly in accordance with the preferred embodiment of the present invention is eased by compression of the spring 100 and sliding it in a manner such that the coupling ring 120 slides over the pin 130 at the groove 132, the sliding motion opening jaws 134, 136 of the ring portion 120 of the spring 100. The jaws 134, 136 close over the pin 130 when the spring 100 is moved into a position such that the aperture 138, having an opening of dimensions substantially similar to the dimensions of the grooved portion 132 of the pin 130, is over the groove 132.

Referring to FIG. 5, the spring 100 is shown coupled to the pin 130 for construction of the belt assembly having a belt clip 14 for coupling to a back cover 30 of a device. As can be seen, the head 140 of the pin 130 and the retaining portion 120 of the spring 100 prevent the pin 130 from laterally moving within the pin holes of the spring 100 in the back cover 30. Therefore, the pin is firmly retained within the pin holes. The spring 100 constructed in accordance with the preferred embodiment of the present invention allows for ease of manufacture by removing the necessity of an additional E-ring to hold the pin 130 in place.

Additionally, the present invention advantageously uses the force exerted by the spring 100 against the back cover 30 in the belt clip 14 for retaining the pin 130. The spring 100 increases the stability of the belt clip assembly by firmly holding the pin 130 within the pin holes. Additional stability for the belt clip assembly and for the spring 100 can be achieved by forming two coupling rings 120 on opposite sides of the spring 100 to comprise a retaining portion 102 of the spring 100. The two coupling rings 120 would fit into properly formed grooves 132 within the pin 130. Thus, in addition to the stability of the spring 100 within the belt clip assembly achieved by the force exerted by the spring 100 and the protrusions 52 which fit into retaining grooves 50 on the belt clip and the back cover 30, the structure of the retaining portion 102 and the grip of the coupling rings 120 around the grooved portions 132 of the pin 130 increase stability and lessen the chance for spring slippage within the belt clip assembly.

Referring to FIG. 6, a selective call receiver which receives and decodes radio frequency selective call messages is shown having the belt clip assembly in accordance with the present invention coupled thereto. The housing 202 of the selective call receiver houses selective call circuitry 204 which performs the receiving and decoding of the selective call messages. The housing 202 has a back cover portion 206 to which the belt clip assembly (shown in greater detail in FIG. 5) is attached. The preferred embodiment of the present invention is particularly suitable to a selective call receiver such that when selective call messages are received and decoded the user may unclip a selective call receiver from, for example, an article of clothing to review a selective call message on a display 208. Also, the user may find it necessary to activate certain user interface controls 210 which cannot be easily accessed by the user when the selective call receiver is clipped to an article of clothing. The belt clip assembly in accordance with the preferred embodiment of the present invention allows for increased stability of the belt clip 14 and ease of manufacture.

By now it should be appreciated that there has been provided a clamping device for clamping a pin within a belt clip assembly without requiring additional manufacturing labor and which can secure the pin without being capable of working itself free.

What is claimed is:

1. A belt clip assembly for clamping a device onto thin material, the device having a backcover including a first set of ears with a first set of pin holes therein, the belt clip assembly comprising:

a belt clip having a second set of ears with a second set of pin holes therein;

a pin for establishing an axis of rotation, the pin passing through said first set of pin holes and said second set of pin holes; and a spring formed to apply force to maintain said belt clip in a closed position against said back cover, said spring having a retaining ring formed integrally therewith, the retaining ring coupling to said pin for retaining said pin within said first and second set of pin holes.

2. The belt clip assembly of claim 1 wherein the spring comprises:

a first portion having a first end for connecting to the backcover and for exerting force thereagainst and a second end located opposite from said first end;

a second portion having a first end for connecting to the belt clip and for exerting force thereagainst and a second end located opposite from said first end, wherein said second end of said first portion is coupled to said second end of said second portion, of said second portion, and wherein said retaining ring is coupled between said first portion and said second portion.

3. The belt clip assembly of claim 2 wherein said retaining ring is formed to couple said first portion to said second portion at a fractional portion of the distance between said first end and said second end of said first and second portions.

4. The belt clip assembly of claim 3 wherein said first portion and said second portion respectively have a first side and a second side running opposite thereto along the length of said first and second portions, and wherein said retaining ring is formed to couple said first side of said first portion to said first side of said second portion.

5. The belt clip assembly of claim 3 wherein said first portion and said second portion respectively have a first side and a second side running opposite thereto along the length of said first and second portions, and wherein said retaining ring comprises:

a first coupling ring formed to couple said first side of said first portion to said first side of said second portion; and a second coupling ring formed to couple said second side of said first portion to said second side of said second portion.

6. The belt clip assembly of claim 5 wherein the pin has a first pin retaining groove and a second pin retaining groove formed therein, and wherein the first coupling ring of said spring couples with said pin so that a portion of said first coupling ring fits within said first pin retaining groove, and wherein the second coupling ring of said spring couples with said pin so that a portion of said second coupling ring fits within said second pin retaining groove.

7. The belt clip assembly of claim 2 wherein the belt clip has a spring retaining groove formed therein and wherein the second portion of said spring has a protrusion formed at said first end for fitting into said spring retaining groove.

8. The belt clip assembly of claim 2 wherein the back cover has a spring retaining groove formed therein and wherein the first portion of said spring has a protrusion formed at said first end for fitting into said spring retaining groove.

9. The belt clip assembly of claim 1 wherein the pin has a pin retaining groove formed therein and wherein the retaining ring of said spring couples with said pin so that a portion of said retaining ring fits within said pin retaining groove.

10. A selective call receiver with belt clip assembly comprising:

selective call receiver circuitry for receiving and decoding selective call messages;

a housing for housing the selective call receiver circuitry, the housing having a back cover, the back cover having a set of ears formed thereon, the set of ears including a first set of pin holes therein;

a belt clip having a set of ears formed thereon, the set of belt clip ears including a second set of pin holes therein;

a pin for establishing an axis of rotation, the pin passing through said first set of pin holes and said second set of pin holes; and a spring formed to apply force to maintain said belt clip in a closed position against said back cover, said spring having a retaining ring formed integrally therewith, the retaining ring coupling to said pin for retaining said pin within said first and second set of pin holes.

* * * * *

UNITED STATES PATENT AND TRADEMARK OFFICE

CERTIFICATE OF CORRECTION

PATENT NO. : 5,185,906

DATED : February 16, 1993

INVENTOR(S) : Dwight David Brooks

It is certified that error appears in the above-identified patent and that said Letters Patent is hereby corrected as shown below:

Column 4, line 54, after "end", insert --of said second portion--.

Column 4, line 57, delete "of said second portion".

Signed and Sealed this

Fifth Day of April, 1994

*Attest:*

*Attesting Officer*

BRUCE LEHMAN

*Commissioner of Patents and Trademarks*